US005768968A

United States Patent [19]

Park et al.

[11] Patent Number: 5,768,968

[45] Date of Patent: Jun. 23, 1998

[54] PLASTIC FILM FOOD WRAP DISPENSER

[76] Inventors: Young Ho Park; Kathy A. Park, both of 1639 Holly Ave., Northbrook, Ill. 60062

[21] Appl. No.: 628,889

[22] Filed: Apr. 5, 1996

[51] Int. Cl.[6] ..... B26D 1/18

[52] U.S. Cl. ..... 83/614; 83/627; 83/418

[58] Field of Search ..... 83/613, 614, 623, 83/627; 831/401, 703, 418

[56] References Cited

U.S. PATENT DOCUMENTS

| | | | |
|---|---|---|---|
| D. 357,377 | 4/1995 | Manu et al. . | |
| 4,346,829 | 8/1982 | Myers . | |
| 4,455,905 | 6/1984 | Raymond | 83/614 |
| 4,754,674 | 7/1988 | Perlman | 83/614 |
| 4,787,284 | 11/1988 | Chen | 83/614 |
| 4,932,560 | 6/1990 | Roen . | |
| 5,007,319 | 4/1991 | Armbruster | 83/614 |
| 5,044,241 | 9/1991 | Labrecque | 83/614 |
| 5,103,710 | 4/1992 | Ross | 83/614 |
| 5,107,734 | 4/1992 | Armbruster | 83/614 |
| 5,146,828 | 9/1992 | Huang et al. | 83/627 |
| 5,253,560 | 10/1993 | McDonald et al. . | |
| 5,275,321 | 1/1994 | Manu et al. . | |
| 5,282,349 | 2/1994 | Siegel . | |
| 5,350,099 | 9/1994 | Kienzle . | |
| 5,398,576 | 3/1995 | Chiu | 83/614 |
| 5,440,961 | 8/1995 | Lucas, Jr. et al. | 83/614 |
| 5,442,983 | 8/1995 | D'Angelo et al. | 83/614 |
| 5,503,053 | 4/1996 | Onishi et al. | 83/614 |
| 5,524,515 | 6/1996 | Boda | 83/614 |
| 5,537,904 | 7/1996 | Albin | 83/614 |
| 5,613,415 | 3/1997 | Sanpei | 83/614 |

*Primary Examiner*—Maurina T. Rachuba
*Attorney, Agent, or Firm*—Mason, Kolehmainen, Rathburn & Wyss

[57] ABSTRACT

A dispenser for plastic film, food wrap is provided. The dispenser includes a base for supporting a roll of the plastic film wrap, a puller for engaging an end of the plastic film wrap and removing a selected length of the plastic film wrap, and a cutter movable across the width of the plastic film wrap for cutting said selected length of the plastic film wrap from the roll.

13 Claims, 3 Drawing Sheets

PLASTIC FILM FOOD WRAP DISPENSER

FIELD OF THE INVENTION

The present invention relates to a dispenser, and more particularly for a dispenser for plastic film, food wrap for use in the home.

DESCRIPTION OF THE PRIOR ART

Often household consumer plastic film, food wrap is provided in a roll and packaged in a box. The box usually includes a cutting edge along one side for cutting the plastic film, food wrap after a desired amount of the plastic film, food wrap has been unrolled. However, often it is difficult and time consuming for the user to unroll the plastic film, food wrap.

A need exists for an effective dispenser for household consumer plastic film, food wrap. It is desirable to provide such dispenser that overcomes many of the disadvantages of prior art arrangements.

SUMMARY OF THE INVENTION

Important objects of the present invention are to provide a dispenser for household consumer plastic film, food wrap; to provide such a dispenser that is easy to use; to provide such a dispenser that is simple in arrangement and economical to manufacture.

In brief, a dispenser for plastic film, food wrap includes a base for supporting a roll of the plastic film wrap, a puller for engaging an end of the plastic film wrap and removing a selected length of the plastic film wrap, and a cutter movable across the width of the plastic film wrap for cutting said selected length of the plastic film wrap from the roll.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
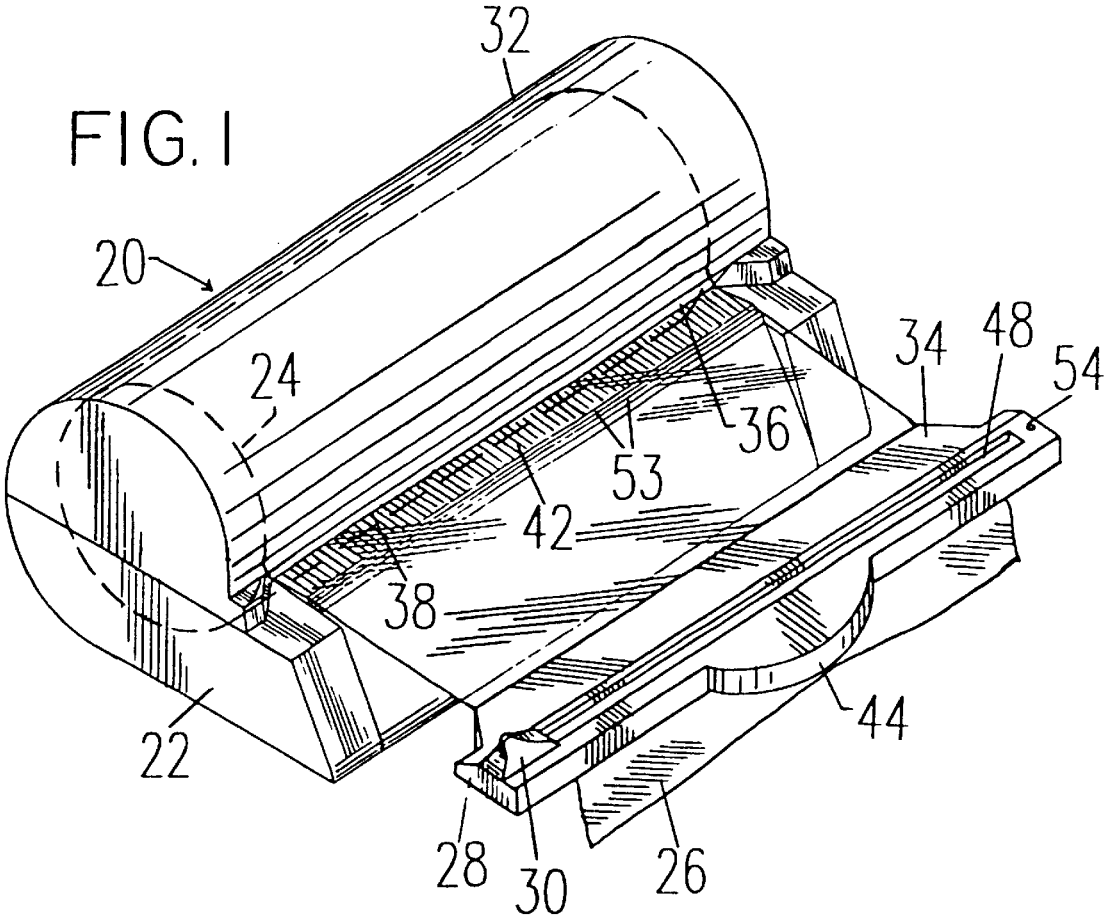
FIG. 1 is perspective view illustrating a dispenser for household consumer plastic film, food wrap arranged in accordance with the present invention.
Figure 2:
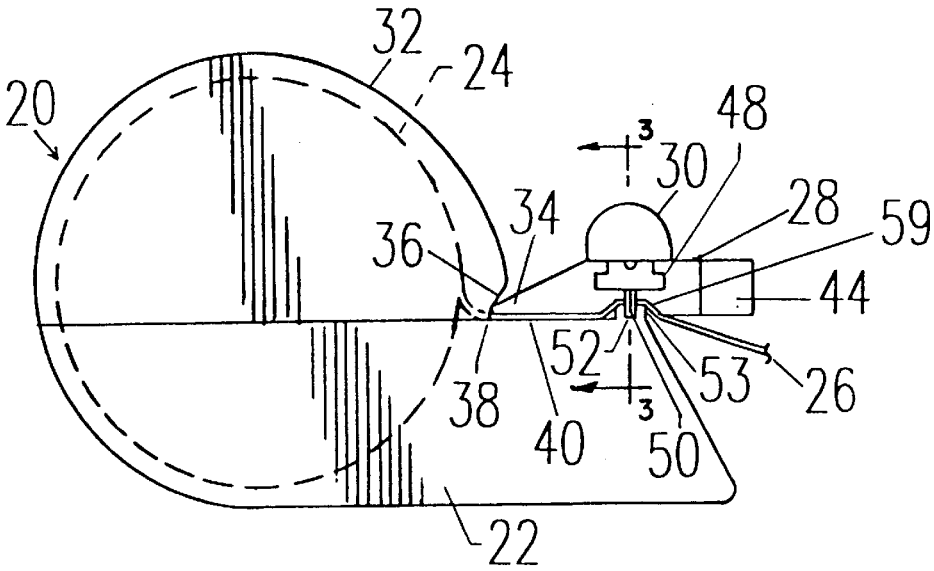
FIG. 2 is a side view of the dispenser of FIG. 1.

Having reference now to the drawings, in FIGS. 1 and 2, there is shown a dispenser for household consumer plastic film, food wrap generally designated by the reference character 20 and arranged in accordance with the present invention.

Figure 9:
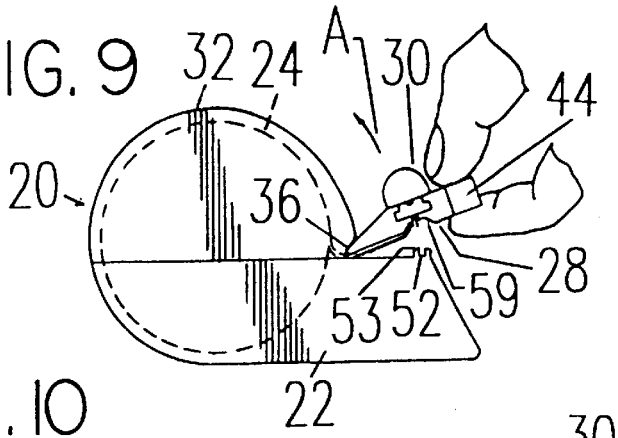
FIGS. 9–12 are side views of the dispenser of FIG. 1 illustrating the operation of the dispenser in accordance with the invention.
Figure 10:
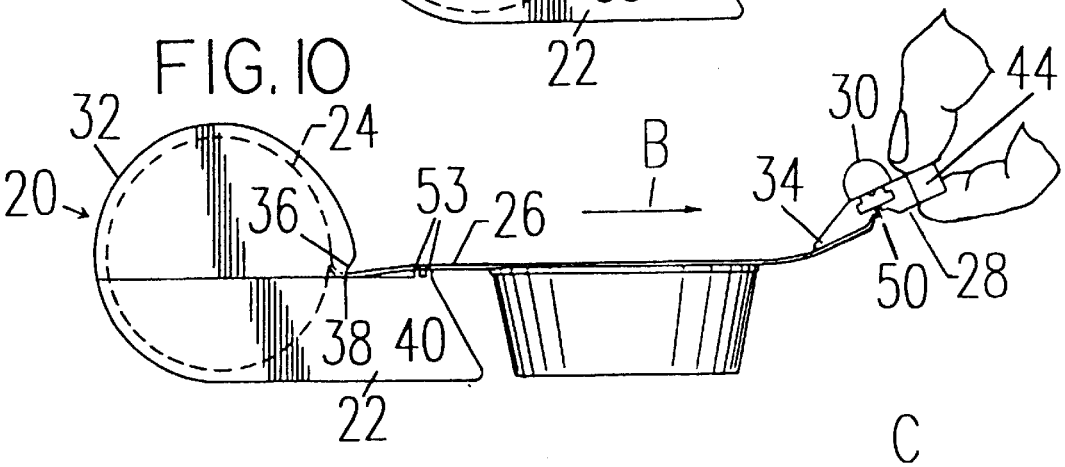

Referring also to FIGS. 9–12, plastic film, food wrap dispenser 20 includes a base generally designated by 22 for supporting a roll 24 of the plastic film wrap shown in dotted line with a film portion 26 extending outside the base 22. Plastic film, food wrap dispenser 20 includes a puller 28 for engaging an outwardly extending plastic film wrap portion 26 and for removing a selected length of the plastic film wrap as shown in FIGS. 9 and 10. Plastic film, food wrap dispenser 20 includes a cutter 30 movable across the width of the plastic film wrap portion 26 for cutting the selected length of the plastic film wrap from the roll 24.

Dispenser base 22 includes an upper, movable cover 32 for receiving and enclosing the roll 24 of plastic film wrap. The base 22 including the cover 32 can be formed of wood or various plastic materials. Dispenser puller 28 includes a forward nose portion 34 received within a corresponding recessed portion 36 of the base 22. The film portion 26 extends outside the base 22 through a film-receiving slot 38 formed between the base 22 and cover 32 as shown in FIG. 2. The nose portion 34 has a length approximately equal to a width of the plastic film wrap. Puller 28 is tilted upwardly as indicated by an arrow A so that the nose portion 34 frictionally engages the outwardly extending film portion 26 as shown in FIG. 9.

Dispenser base 22 includes a film supporting surface 40 outside the cover 32 as shown in FIG. 1. The film supporting surface 40 is formed with grooves 42 to facilitate easy removal of the film portion 26. Also the film supporting surface can be formed of a selected material that would not stick to the plastic film to facilitate easy removal of the film portion 26.

Figure 11:
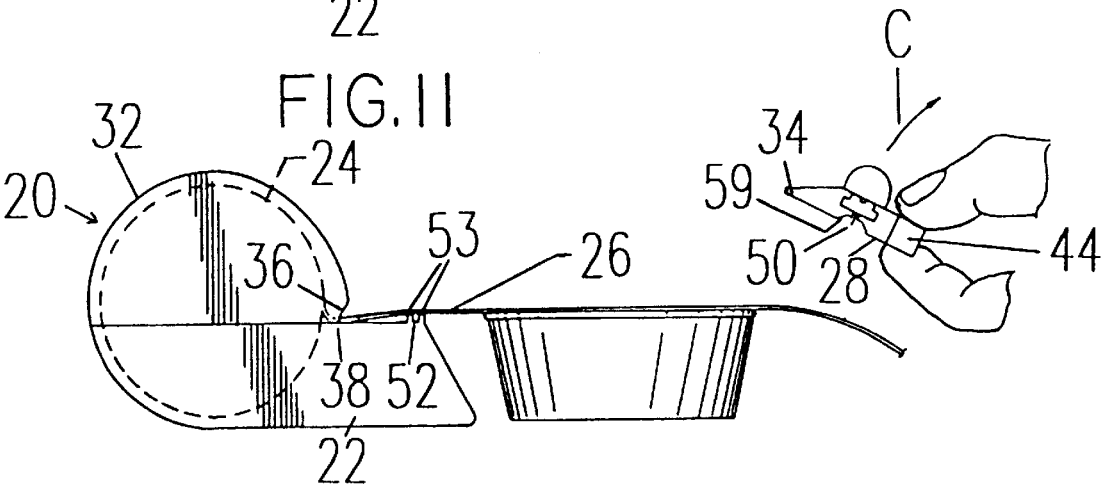
Figure 12:
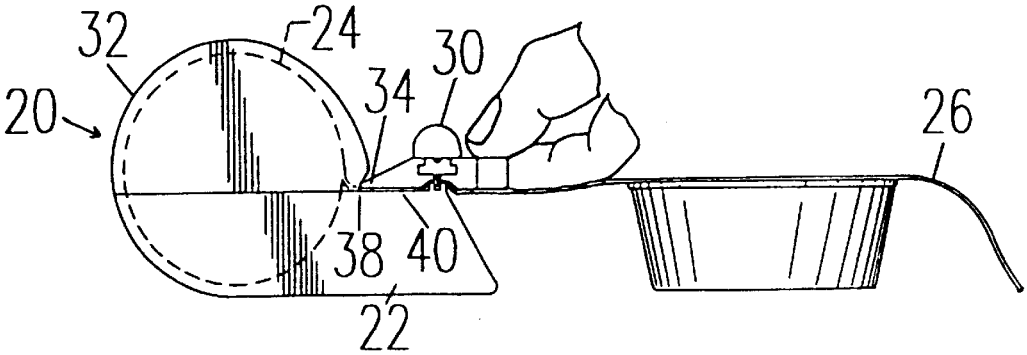

A rearwardly extending grip or holder 44 of the puller 28 is held by the user. The user holds the grip 44 and moves the puller 28 away from the base 22 as indicated by an arrow B in FIG. 10 with the nose portion 34 frictionally engaging the film 26 until a desired length of film has been removed. As shown in FIGS. 10, 11 and 12, a selected film length is removed to cover a separate container or dish 46.

Then the user rotates the puller 28 as indicated by an arrow C to disengage the nose portion 34 of the puller 28 from the film 26. Then the user seats the puller 28 on the base 22 as shown in FIG. 12. The puller 28 can be formed of a plastic or similar material that will stick or adhere to the plastic wrap 26.

An elongated, biased slot 48 in the puller 28 receives and positions the cutter 30 to facilitate easily sliding the cutter 30 for cutting the film 26. The slot 48 has a length that is greater than the width of the film 26. The elongated, biased slot 48 is shaped corresponding to the cutter 30 to receive, position and retain the cutter 30 within the puller 28. The cutter 30 includes a downwardly depending blade 50 received and solidly positioned within a corresponding slot 52 defined by a pair of opposed ledges or raised surfaces 53 in the base 22. The raised surfaces 53 defining the blade-receiving slot 52 supports and positions the film 26 before cutting. The user moves the cutter 30 along the slot 48 from a starting position at one end of the slot 48, for example, as shown in FIG. 1 to the opposite end of the slot 48 to cut the film 26 with the cutter blade 50, after the desired film length has been removed as shown in FIG. 12. A pair of holes 54 are provided at opposed ends of the puller 28 to define starting positions for the cutter 30.

Figure 3:
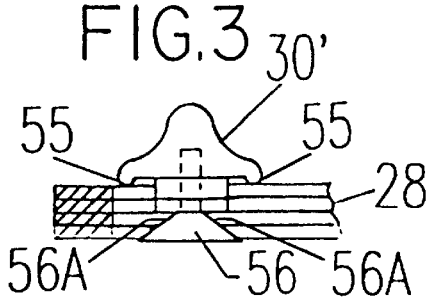
FIG. 3 is a detailed view illustrating an alternative cutting member of the dispenser of FIG. 1.
Figure 4:
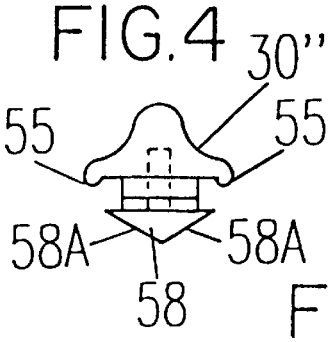
FIG. 4 is a detailed view illustrating another alternative cutting member of the dispenser of FIG. 1.

Referring also to FIGS. 3 and 4, there are shown a first alternative cutting member or cutter 30' and a second alternative cutter 30" for use in the dispenser 20. Cutters 30' and 30" include a pair of downwardly depending nubs or guides 55 received in a respective one of the holes 54 at a starting position and that facilitate easily sliding the cutter 30, 30' and 30" through the slot 48 of the puller 28 to cut the film. Cutter 30' includes an alternatively arranged wedge shaped blade 56 having upper cutting surfaces 56A. Cutter 30" includes a further alternatively shaped blade 58 having lower cutting surfaces 58A.

Referring to FIGS. 9–12, the cutting blade 50, 56 or 58 is received within a recessed portion 59 of the puller 28 so that the blade does not extend below the lower surface of the puller 28. With the cutting blade 50, 56 or 58 confined within the recessed portion 59, the risk of the user being cut by the cutting blade 50, 56, or 58 is minimized.

Referring now to FIGS. 5, 6, 7 and 8, there is shown an alternate electrical motor-driven cutting type dispenser generally designated by the reference character 20' for dispensing a roll 24 of household consumer plastic film, food wrap arranged in accordance with the present invention. An electric motor 60 is drives a belt 62 operatively coupled to a cutter 64. The cutter 64 includes an upwardly extending blade 66 for cutting the film 26. The electric motor 60, belt 62 and cutter 64 are contained within a dispenser base 22'.

Figure 5:
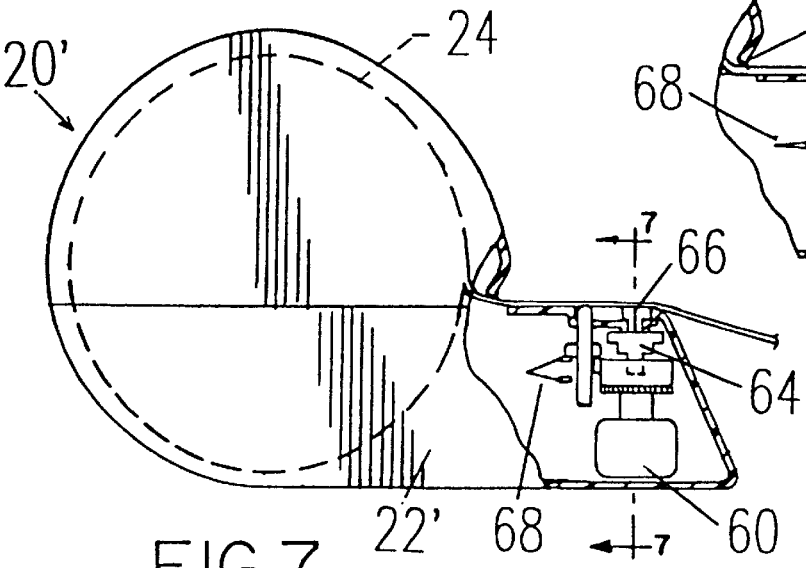
FIG. 5 is side view illustrating an alternate electrical motor-driven cutting type dispenser for household consumer plastic film, food wrap arranged in accordance with the present invention with a film puller removed.
Figure 6:
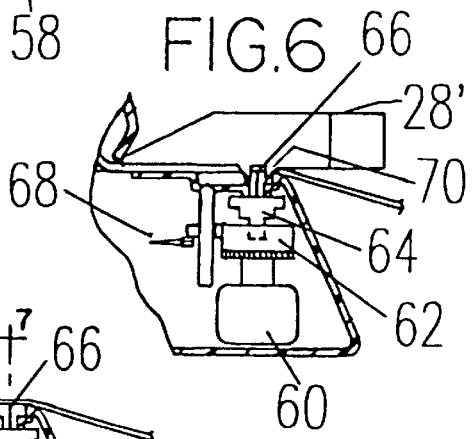
FIG. 6 is a detailed view of the electrical motor-driven cutting type dispenser of FIG. 5 together with a puller.
Figure 7:
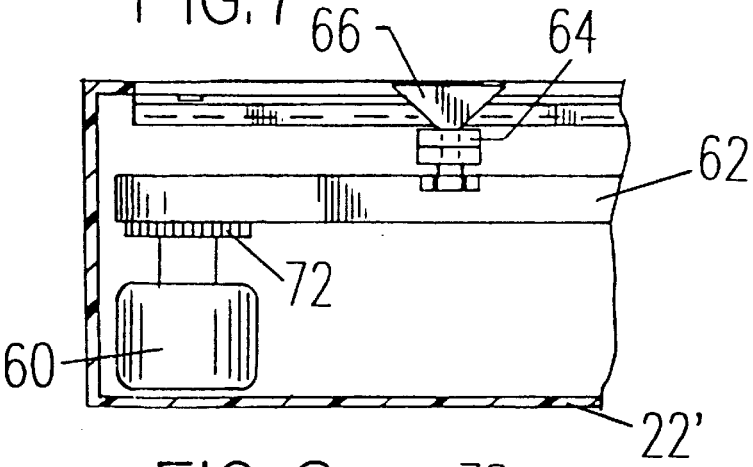
FIG. 7 is a sectional view of the electrical motor-driven cutting type dispenser taken along line 7—7 of FIG. 5.
Figure 8:
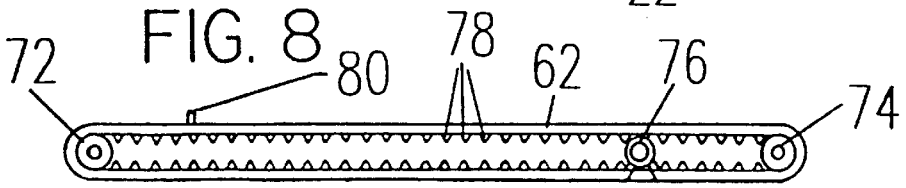
FIG. 8 is a side view illustrating of an electrical motor-driven belt of the electrical motor-driven cutting type dispenser of FIG. 5.

A puller 28' includes a recess 70 for receiving the blade 66. The puller 28' is utilized in the same fashion as puller 28 of dispenser 20 to remove a desired length of film 26 as illustrated in FIGS. 9–12. An ON/OFF switch 68 schematically shown in FIGS. 5 and 6, is engaged by the user to start the cutting operation. Belt 62 extends between spaced apart supporting gears 72 and 74 with gear 72 being driven by the electric motor 60. A ring 76 carried by the belt 62 moves the cutter 64 and blade 66 to cut the film 26 with rotation of the belt. A switch disconnector 80 causes the ON/OFF switch 68 to open and automatically deactivate the electric motor 60 at a predetermined position of the cutter 64 after the film 26 has been cut.

While the present invention has been described with reference to the details of the embodiments of the invention shown in the drawing, these details are not intended to limit the scope of the invention as claimed in the appended claims.

What is claimed is:

1. A dispenser for plastic film wrap comprising:

a base for supporting a roll of the plastic film wrap;

a puller for engaging an end of the plastic film wrap and removing a selected length of the plastic film wrap; and a cutter movable across the width of the plastic film wrap for cutting said selected length of the plastic film wrap from the roll; wherein said puller includes an elongated slot for receiving said cutter.

2. A dispenser for plastic film wrap as recited in claim 1, wherein said base includes a movable cover for enclosing the roll of plastic film wrap.

3. A dispenser for plastic film wrap as recited in claim 2, wherein said base includes a film supporting surface extending outside said movable cover.

4. A dispenser for plastic film wrap as recited in claim 3, wherein said film supporting surface includes a plurality of grooves.

5. A dispenser for plastic film wrap as recited in claim 1, wherein said base includes a slot defined by opposed film supporting raised surfaces for receiving a cutter blade.

6. A dispenser for plastic film wrap as recited in claim 1, wherein said puller includes a nose portion received within a corresponding recess formed in said base.

7. A dispenser for plastic film wrap as recited in claim 1, wherein said nose portion has a length approximately equal to a width of the plastic film wrap.

8. A dispenser for plastic film wrap as recited in claim 1, wherein said elongated slot is shaped for positioning and retaining said cutter within said puller.

9. A dispenser for plastic film wrap as recited in claim 1, wherein said elongated slot has a length greater than a width of the plastic film wrap.

10. A dispenser for plastic film wrap as recited in claim 1, wherein said cutter includes a downwardly depending blade.

11. A dispenser for plastic film wrap as recited in claim 10, wherein said puller includes a recessed portion for receiving said downwardly depending blade, whereby risk to a user is minimized.

12. A dispenser for plastic film wrap comprising:

a base for supporting a roll of the plastic film wrap; said base including a removable cover for receiving an enclosing said roll of plastic film wrap;

a puller; said puller including a forward nose portion for engaging an end of the plastic film wrap and removing a selected length of the plastic film wrap; said puller including an elongated slot; and a cutter including a cutter blade received within said elongated slot in said puller; said cutter movable across the width of the plastic film wrap for cutting said selected length of the plastic film wrap from the roll.

13. A dispenser for plastic film wrap as recited in claim 12, wherein said cutter is mounted on said puller and said cutter blade extends downwardly below said elongated slot.

* * * * *